US006270406B1

(12) United States Patent
Sultan

(10) Patent No.: US 6,270,406 B1
(45) **Date of Patent: *Aug. 7, 2001**

(54) TYPE OF INSTANT SCRATCH-OFF LOTTERY GAMES

(76) Inventor: Hashem Sultan, 1451 NW. 167 Ave., Pembroke, FL (US) 33028

( * ) Notice: Subject to any disclaimer, the term of this patent is extended or adjusted under 35 U.S.C. 154(b) by 0 days.

This patent is subject to a terminal disclaimer.

(21) Appl. No.: 09/360,501

(22) Filed: Jul. 26, 1999

Related U.S. Application Data

(63) Continuation-in-part of application No. 09/320,516, filed on May 26, 1999.

(51) Int. Cl.[7] ..... A63D 15/20
(52) U.S. Cl. ..... 463/17; 273/269; 283/94
(58) Field of Search ..... 283/901, 903, 283/94; 463/17; 273/269

(56) References Cited

U.S. PATENT DOCUMENTS 5,074,566 12/1991 Desbiens .
5,109,153 * 4/1992 Johnsen .
5,118,109 6/1992 Gumina .
5,217,258 * 6/1993 Sanderson .
5,286,061 * 2/1994 Behm .
5,411,260 5/1995 Smith .
5,690,367 11/1997 Fromer .
5,887,906 3/1999 Sultan .
6,047,964 * 4/2000 Lawandy .

* cited by examiner

*Primary Examiner*—Benjamin H. Layno
*Assistant Examiner*—Vishu K. Mendiratta
(74) *Attorney, Agent, or Firm*—Wood, Herron & Evans, L.L.P.

(57) ABSTRACT

A tamper resistant lottery ticket for preventing payoff of invalid tickets comprises a ticket body and a plurality of game fields which are choosable by a lottery player. At least one winning symbol for the ticket is positioned in a game field, and a scratch-off material covers the game fields to hide contents of the game fields and therefore hide the at least one winning symbol. The scratch-off material is removable by a lottery player to reveal the contents of a game field when the game field is chosen. A readable security code is printed in each of the game fields, and the security code is covered by a scratch-off material with the at least one winning symbol and is revealed when the content of the game field is chosen and the scratch-off material is removed. A magnetic strip is utilized to contain the serial number of the lottery ticket and any other information necessary for identifying the ticket or playing the particular lottery game. The magnetic strip may be read in a conventional way, and the information extracted from the magnetic strip is used to verify the winning ticket and its validity. The security codes of the ticket may be read and used with the magnetic strip information to ensure that the proper number of game field contents are revealed and the lottery ticket is valid.

13 Claims, 7 Drawing Sheets

TYPE OF INSTANT SCRATCH-OFF LOTTERY GAMES

RELATED APPLICATIONS

The present application is a continuation-in-part of application Ser. No. 09/320,516, entitled "A New Type of Instant Scratch-Off Lottery Games"filed May 26, 1999. The parent application is incorporated by reference.

FIELD OF THE INVENTION

The invention relates to instant scratch-off lottery games in general, and to means for preventing fraudulent alteration of the ticket.

BACKGROUND OF THE INVENTION

Instant scratch-off lottery tickets are being increasingly sold around the world.

Instant scratch-off lottery tickets contain hidden preprinted winning and losing game data which distinguish this form of lottery from the various other forms in which winning numbers are drawn some time after the sale of the ticket (conventional state lottery).

This scratch-off lottery utilizes a ticket, card, or other paper imprinted with indicia such as information relating to certain numbers, symbols, words and the like which indicate whether the bearer has won a prize. Such tickets must obscure the win-indicating information from observation by both the ticket distributor and the ticket purchaser as well until after the ticket has been sold. In this way, neither the ticket distributor nor the purchaser can determine which of a large number of tickets contain the win-indicating information.

After the ticket is purchased, the purchaser removes the material which obscures the information imprinted thereon. Once this coating is removed, the purchaser will know if he holds a winning ticket.

The games of the instant lotteries are generally of five main types:

1—Match three amounts or symbols and win that amount.

2—Match any of your preprinted numbers to another set of preprinted numbers and win a predetermined amount.

3—Bingo-type game

4—Compare your preprinted numbers or playing cards to a preprinted number(s) or playing cards. You win if you get higher numbers, etc.

5—You win if you have a preprinted winning symbol in your card.

All of the above categories of games and all the other currently available instant lottery games have a predetermined number of winning tickets. The tickets that have the winning indicia are sold randomly among the other tickets. The purchaser has no role in making the ticket he buys a winning one, nor has he the choice of entering his lucky numbers as he does in purchasing the conventional lottery ticket.

Players feel more satisfaction if they can choose their own numbers compared to having a ticket with preprinted winning indicia.

The current invention provides the combined advantages of the conventional lottery by allowing the purchaser to enter his chosen number and the advantage of the instant scratch-off lottery tickets by enabling the purchaser to immediately learn if the ticket is a winner or loser.

It is, therefore, a prime object of the current invention to provide a novel type of instant lottery scratch-off game in which any ticket could be a winning one if the player entered the correct numbers printed on that particular ticket.

It is another object of the present invention to provide endless new varieties of games where only the player has a major input and contribution to make the ticket a winning one.

It is another object of this invention to provide the player with prior knowledge of the amount of the prize and the probability of winning for each particular game.

It is another object of the current invention to create more trust and confidence in the lottery agency by letting the player choose his own numbers.

It is another object of the current invention to provide a method for defeating any technique for nondestructive premature reading of the winning number printed on the card by providing a security bar code over-printed on the scratch-off material which covers the boxes which correspond to each number.

The security bar codes will enable the ticket distributor to transfer the information to a central computer of the lottery agency to approve or disapprove the payment of the prizes of the winning tickets.

It is still another objective to allow reading of the information of the ticket rapidly and accurately to determine whether the ticket is valid and whether it is a winning ticket, and also to prevent fraud and counterfeiting.

In view of the above shortcomings of the instant lottery tickets, there is a need in the lottery business for new types of games which combine the advantages of traditional lottery games by allowing players to choose their own numbers and the advantage of the instant scratch-off ticket by allowing immediate learning if the ticket is a winner or loser.

SUMMARY OF THE INVENTION

The current invention relates to the structure of a game card of the instant scratch-off type of lotteries.

The current invention provides the combined advantages of the conventional lottery which allows the player to choose his own number to determine his chance of winning, and the advantage of the instant scratch-off lottery tickets by enabling the player to immediately learn if the ticket is a winning or a losing one.

The invention ensures that the ticket is not invalidated by revealing more data than the player is allowed to reveal. This is achieved by a bar code, readable to a scanner, covering each box representing the number of the set of numbers printed on the card.

The current invention provides a plurality of games allowing the player to pick his own number, which varies with each particular game, which could be pick 1, 2, 3, 4, 5, 6, or more numbers from a set of numbers. Each number of this set is represented by a box covered by the scratch-off material which is over-printed with an appropriate bar code readable to a scanner (such scanners are already widely used in stores).

The winning number for each ticket is chosen randomly by a central processor of the lottery agency and stored in its data associated with the serial number of the ticket which, in one embodiment of the invention, is also printed on the card as a scanner readable bar code. The winning numbers are marked by symbols inside the corresponding boxes and are hidden by the scratch-off material and the over-printed security bar code. The winning numbers are unique for each card.

In accordance with another embodiment of the invention, the serial number is not printed on the ticket body as a code. Rather, the ticket includes a readable magnetic strip which contains the serial number of the ticket. The magnetic strip may also include other information besides the serial number. With such an embodiment, the card may be readable using a conventional magnetic strip reader as is known in the art.

The player is instructed to remove only the material covering the boxes which corresponds to the numbers chosen. If the player reveals more boxes than allowed for that particular game, the card is invalidated and the player loses even if he reveals the correct numbers.

For example, if the player is playing the Pick 3 games, he is instructed to choose only three numbers of a set of numbers printed on the card. He has to remove only the scratch-off material covering the boxes (or fields) of his three selected numbers.

The ticket distributors are provided with scanners (not part of the invention-already available in the market), that can read the serial number of the ticket and the security bar code for each box number to verify that winning numbers are revealed and that only certain numbers of the fields are revealed and the covering security bar codes of the rest of the fields are not violated. The information thus obtained is transferred to the central processor of the lottery agency to approve or disapprove the payment of the prizes. Such a scanner may include a magnetic strip reader, if necessary.

In another embodiment of the invention; the scanner-readable code is placed in all the fields, including the winning fields. The scratch-off material covers all the fields and codes, along with the winning symbols. The scanner may verify that the proper number of fields have been revealed and that the ticket is valid by scanning the codes that are revealed. A winning ticket would be determined as above by the symbols in the revealed fields.

DETAILED DESCRIPTION OF THE INVENTION

The current invention relates to the structure of a game card of the instant scratch-off type of lotteries.

Figure 1:
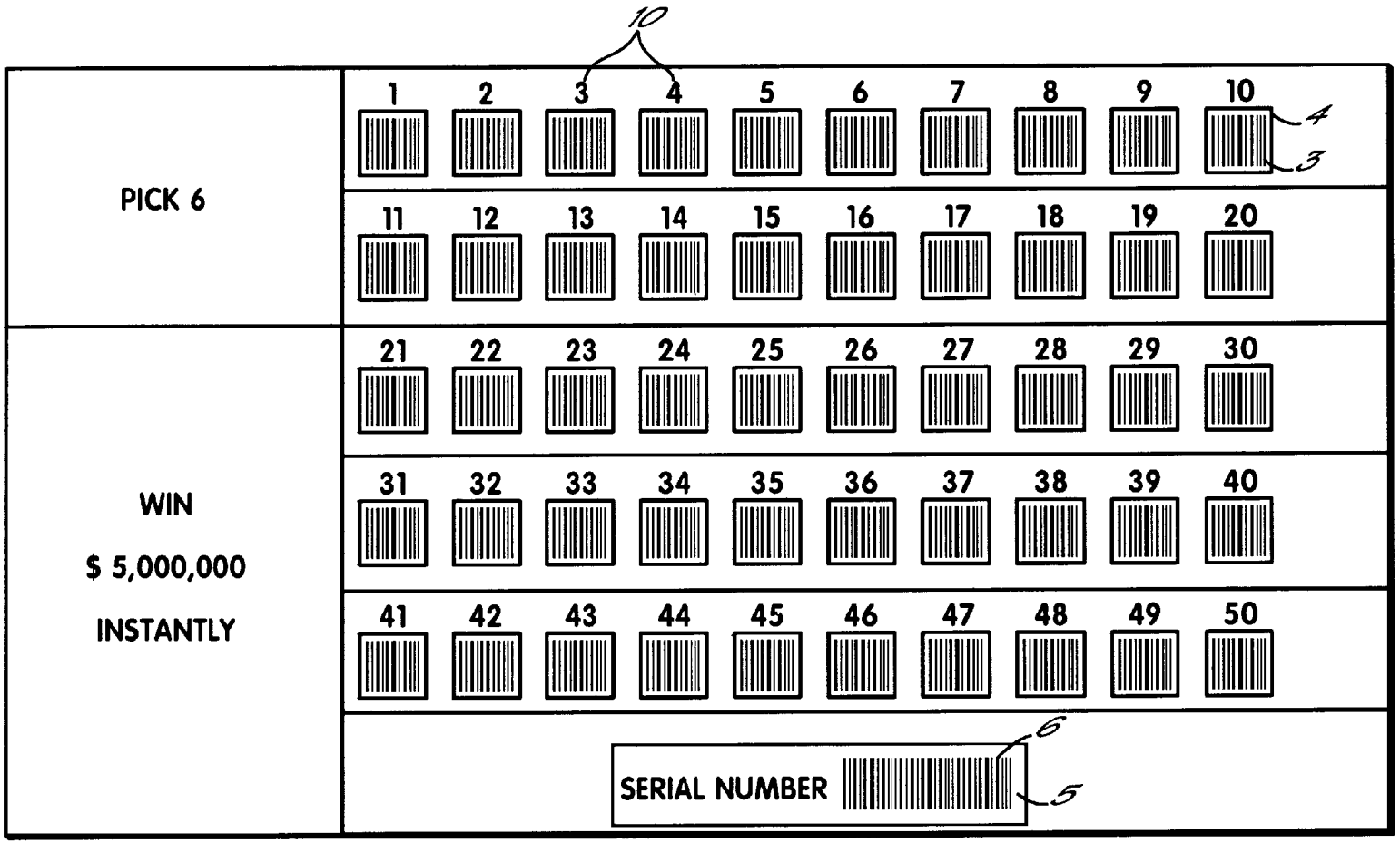
FIG. 1 is a rough drawing of a ticket for Pick 6 numbers showing the numbers and their corresponding boxes covered with a security bar code.

In FIG. 1, an example of the proposed games is illustrated. The manufacturing of these kinds of tickets is well known to those of ordinary skill in the art, and is beyond the scope of this invention.

The card needs to be made of multi-layered card protected against see-through, difficult to forge, in which the hidden data are printed with an ink having no or minimal radio opacity, such as described by Silverschotz et al., in U.S. Pat. No. 5,542,710, and Meloni et al. in U.S. Pat. No. 4,787,950, and by Hansell, U.S. Pat. No. 5,407,535, and by Goldman in U.S. Pat. No. 4,191,376.

The card or ticket body is overprinted with a group of numbers 10. The group may consist of any amount of numbers, which varies with the type of game played and the rules set by the lottery agency.

Each number of this group is represented by a small box 4 or area, or a game field of any other shape, like a circle, heart, etc. The box is covered with a printed security bar code 3 representing the number. This security code is readable to an ordinary scanner available in almost every store. It should be noted that this security code need not be of the bar code type; any symbol readable to scanners can be used.

Figure 6:
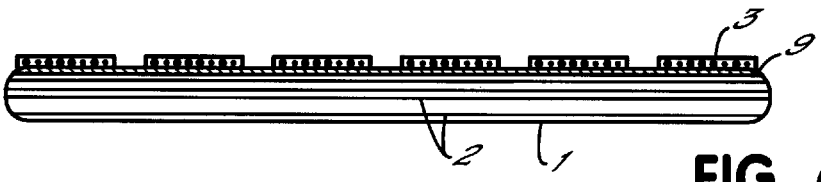
FIG. 6 is a rough drawing of a cross-section of the lottery ticket showing the security bar codes 3 over-printed on the scratch-off material 9.

In FIG. 6, a sectional view of the card is illustrated showing the security code 3 overprinted on the scratch-off material 9 which is coating the other layers 2 of the card or ticket body 1.

The card has a field 5 for the serial number of the card, as well as its scanner readable bar code 6. The bar code is printed on the card itself and may or may not be coated with scratch-off material for covering the serial number and its readable bar code.

The serial number will indicate the predetermined numbers of the field the player is allowed to reveal its content; example 03-000 0000 00000 indicates that the card is a pick 3 fields only, and 05-000 00000 indicates that the card is a pick 5 fields only.

The rest of the serial number is the number of the ticket associated with the predetermined winning numbers chosen randomly by the central processor of the lottery agency.

In accordance with one aspect of the present invention, the serial number is not printed on the ticket body as a bar code. Rather, the inventive ticket body includes a magnetic strip which includes the serial number of the ticket. The magnetic strip might also include additional information regarding the ticket rather than just the serial number, as discussed here. Referring to FIG. 8, an alternative embodiment of the invention is shown as a ticket or ticket body 21. The lottery ticket 21 includes a field 45 for the serial number and other information necessary for the lottery ticket and/or the overall lottery. Rather than a bar code representation of the serial number and other information, the ticket utilizes a magnetic strip 46 which is readable by a conventional strip reader device in order to extract the necessary serial number and other information from the ticket. Similar to the ticket shown in FIG. 7, ticket 21 of FIG. 8 includes game fields which may contain winning symbols 27 that are hidden by scratch-off material 29. The magnetic strip feature and element of the present invention may be utilized with all embodiments of the invention, as disclosed herein and in the Figures.

In combination with the other unique features of the present invention, the lottery ticket utilizing the magnetic strip may be validated quickly and accurately to determine if the proper number of fields have been uncovered by removal of the scratch-off material (as might be determined by serial number information or other information on the magnetic strip) and which of those fields are winning fields. As noted, conventional magnetic strip reading equipment may be utilized with other devices, such as a computer and a bar code scanner, for validating a ticket and determining whether it is a winning ticket for the game to which it pertains. Furthermore, the magnetic strip is utilized to prevent and deter fraud and counterfeiting. The strip might contain specific codes, for example, which are utilized to determine that the ticket is authentic and to thereby prevent fraudulent payment to a person with a counterfeit ticket. Furthermore, the difficulty in determining the specific code required on the ticket would deter counterfeiting attempts.

To that end, one embodiment of the invention is a tamper-resistant lottery ticket with a ticket body having a plurality of game fields to be chosen by a player. Winning symbols are hidden beneath one, and preferably a plurality of, game fields which are choosable by a lottery player. Scratch-off material over the game fields hides the contents of the game fields and therefore hides the contents of the game fields and therefore hides the winning symbols. The material may be removed from one or more chosen game fields to reveal the fields' contents. In one embodiment, a readable security code is covered by scratch-off material and is revealed when the contents of the game field are revealed.

Alternatively, in another embodiment, the readable security code is printed on the scratch-off material and is removable when the scratch-off material is removed. A readable magnetic strip is positioned on the ticket body. The magnetic strip contains information regarding the lottery ticket. For example, the magnetic strip might contain information which indicates a predetermined maximum number of game fields which might be chosen and revealed for that particular lottery ticket game. Other information, such as authenticity information might be utilized on the magnetic strip. The information from the magnetic strip, when combined with security code information, may be used to determine the validity of the lottery ticket, as well as whether it is a winning ticket.

Instructions on the rules of the game are overprinted with the amount of the prizes. For example, in FIG. 1, the player is instructed to pick only six numbers by scratching off the material covering the corresponding six fields to reveal the contents of those fields, from a group of the fields 10. If the player reveals more than six fields, the ticket will be invalidated. This can be immediately recognized by the scanners and/or magnetic strip readers which are reading the ticket.

Each ticket has winning numbers chosen randomly by a central computer processor in the lottery agency and the winning numbers are stored with their corresponding serial number in the computer. The winning numbers of selectable game fields (e.g., 1–6 fields) are associated with the serial number of each ticket.

To verify a winning ticket, the computer should compare the numbers whose security code is erased by removal of the scratch-off with the serial number of the ticket and that only a certain number of fields as instructed are chosen by the player (like six fields in the Pick 6 game) by verifying the integrity of the security codes over the rest of the fields which correspond to the numbers. The serial number of the ticket, and other information on the ticket, which indicates the type of game being played, the number of fields that can be removed for a valid ticket, and the authenticity of the ticket, will be acquired by scanning or reading an informational field, like field 5 or 25, as disclosed herein.

Figure 2:
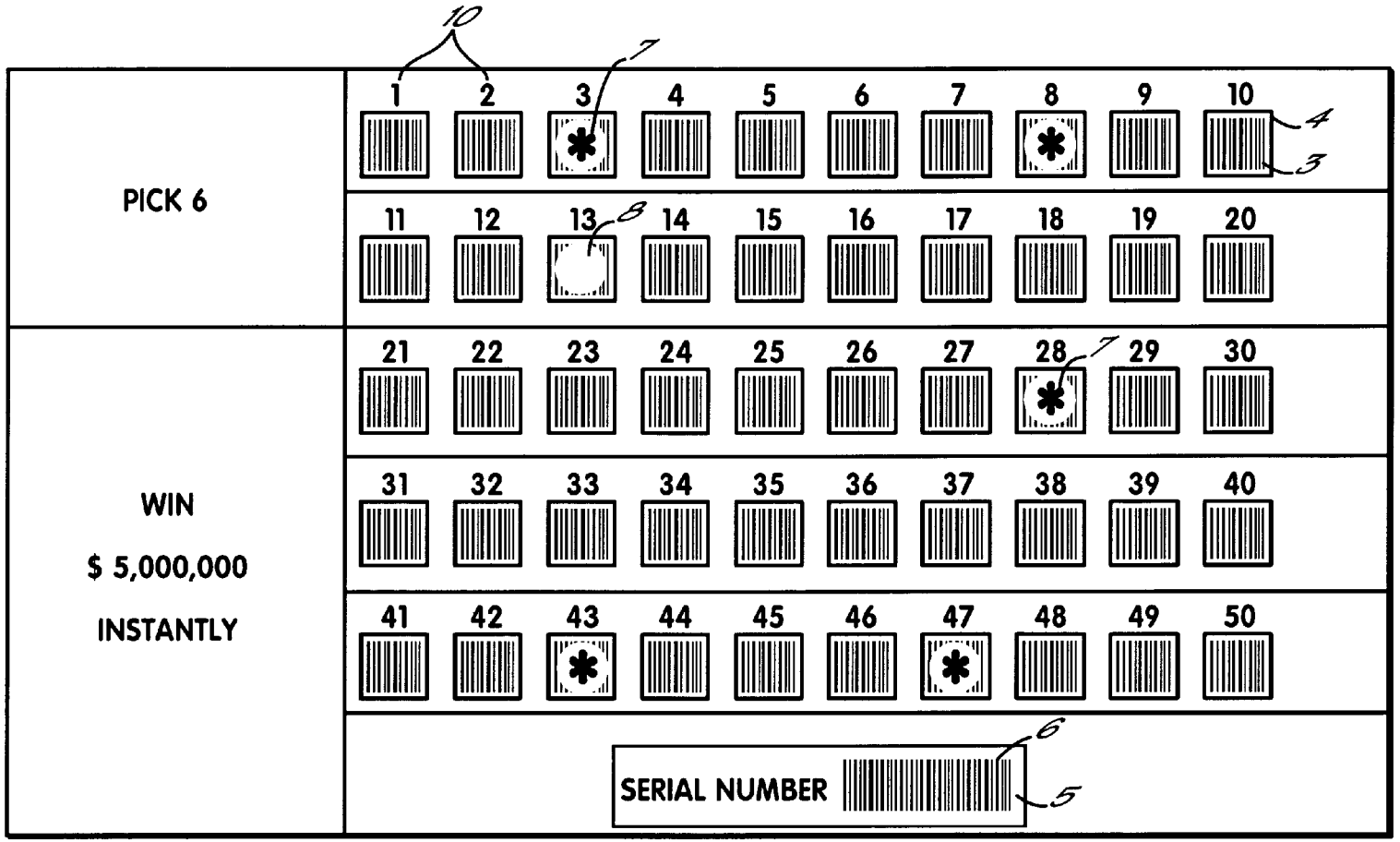
FIG. 2 is a rough drawing of a ticket for Pick 6 numbers, with a player having entered six numbers, 3, 8, 13, 28, 43, and 47. The player matched five numbers of the six.

FIG. 2 shows that by scratching off the security code of the numbers chosen by a player he will immediately learn if he chooses the fields with winning numbers or symbols or not.

Winning numbers are indicated by hidden symbol 7 in the boxes 4 of the numbers. The symbol can be a letter, another number, a word, a certain color, or any other mark or indicator determined by the lottery agency.

It is shown in FIG. 2, as an example, the player has chosen fields numbers 3, 8, 13, 28, 43, and 47. The winning numbers were 3, 8, 28, 35 (which the player did not choose and which is still hidden by the security code), 43, and 47. As seen, the field of number 13 does not have a winning symbol and therefore is represented by either an empty field 8 or another symbol to indicate a non-winning number.

Prizes vary with each particular game and the probability of winning for each game.

In general, the probability of winning for any lottery game is the product of the probability of winning of each one attempt multiplied by the number of attempts. Therefore, in the conventional lottery of Ohio Super Lotto, where players have to choose six numbers from 1 to 47, the probability for each one ticket is 1/1 0,737,573. If the volume of ticket sales exceeds 10 million tickets, the probability of a winner approaches %100.

For the same game (Pick 6 from 1 to 47) on the current invention, the probability for each player remains the same 1/10,737,573, but the probability of a winner remains 1/10, 373,573 because each winning number on a particular card is always played only once.

This will give the lottery agency tremendous benefits. The purchaser, on the other hand, as an individual, is not affected. His chance of winning remains the same whether he played the same game on the conventional lottery or the scratch-off type, but he has the advantage of learning immediately whether he is a winner or not.

By reducing the probability of having a winner, the lottery agency has a great benefit and it allows them to increase the chances and the amount to be won by the player, which generally improves the chance of the player to be a winner, compared to the conventional lottery.

For example, in the Ohio Super Lotto (Pick 6 from 1 to 47), matching four numbers out of six, with a probability of 1/11891, wins only $70–120. With the current invention for the same game, the lottery agency can increase the prize up to $10,000, or can increase the chance of winning by awarding match 3 or 2 numbers out of the six.

Overall, the current invention increases the chances of winning and benefits for the players as well as the lottery agency.

Figure 3:
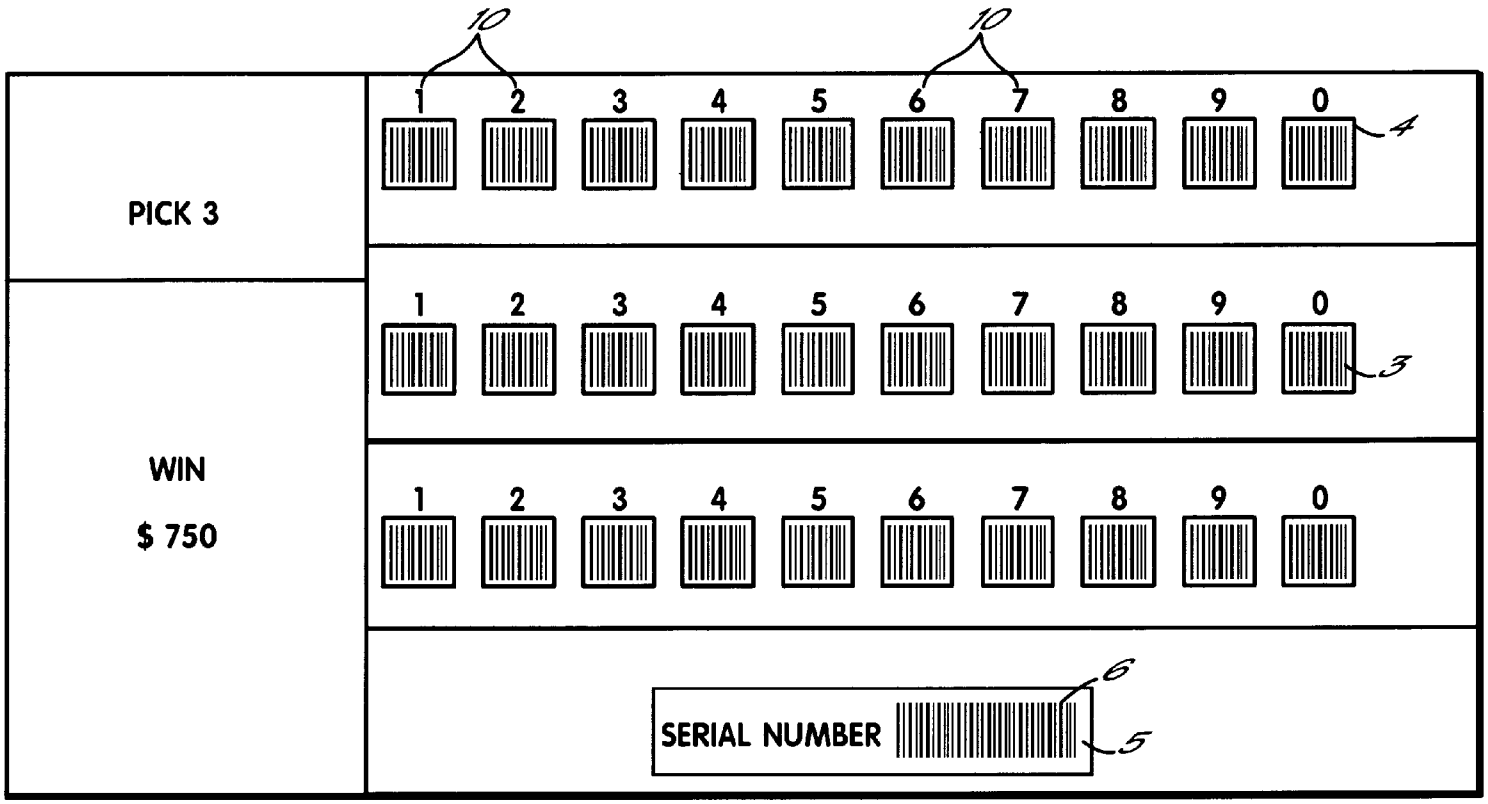
FIGS. 3, 4 and 5 show examples of different types of playing Pick 3 numbers with different probabilities of winning, and hence different prizes.
Figure 4:
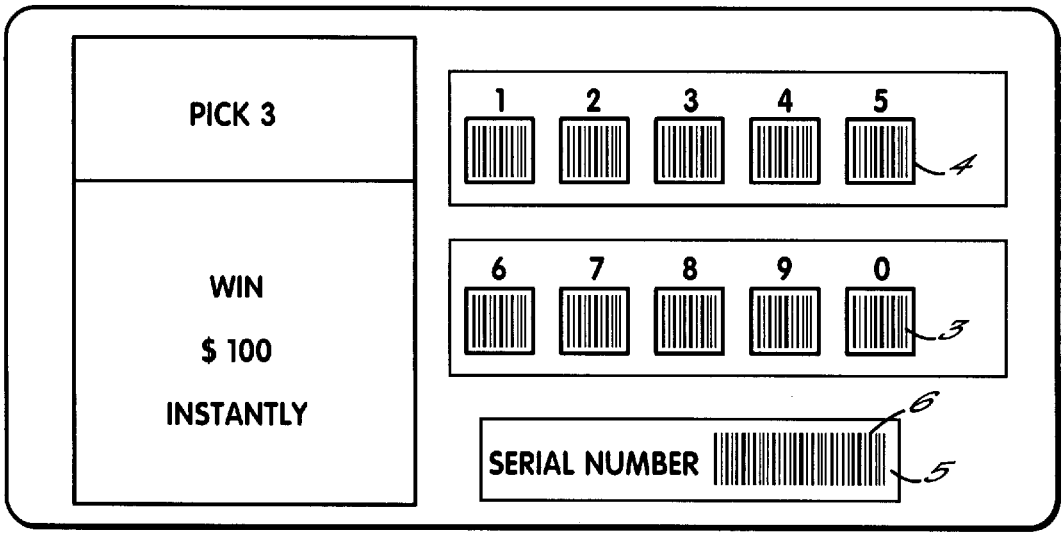
Figure 5:
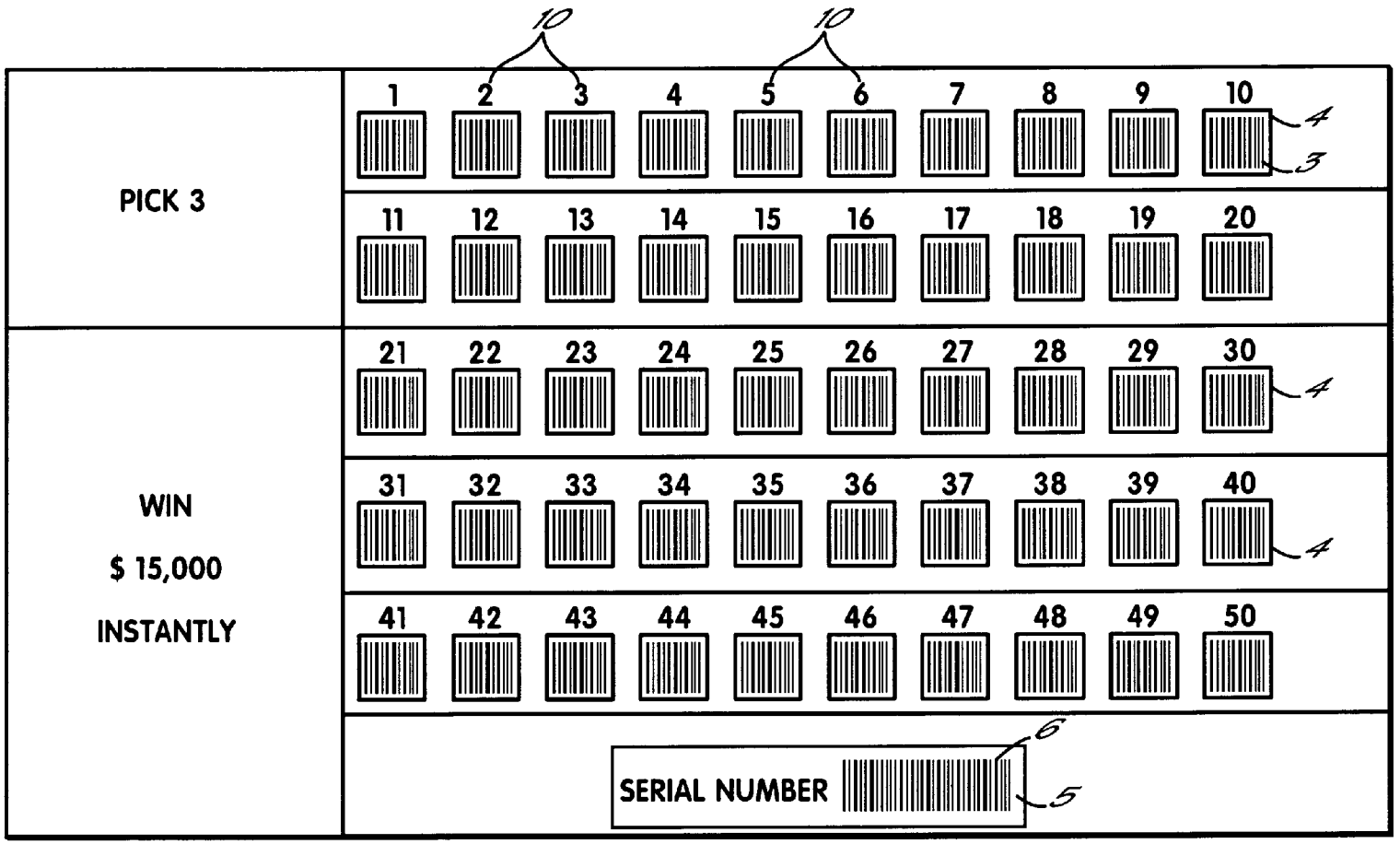

FIGS. 3, 4, and 5 show some of the varieties of games with the prizes varying with changing the set of numbers the player has to choose from.

Figure 7:
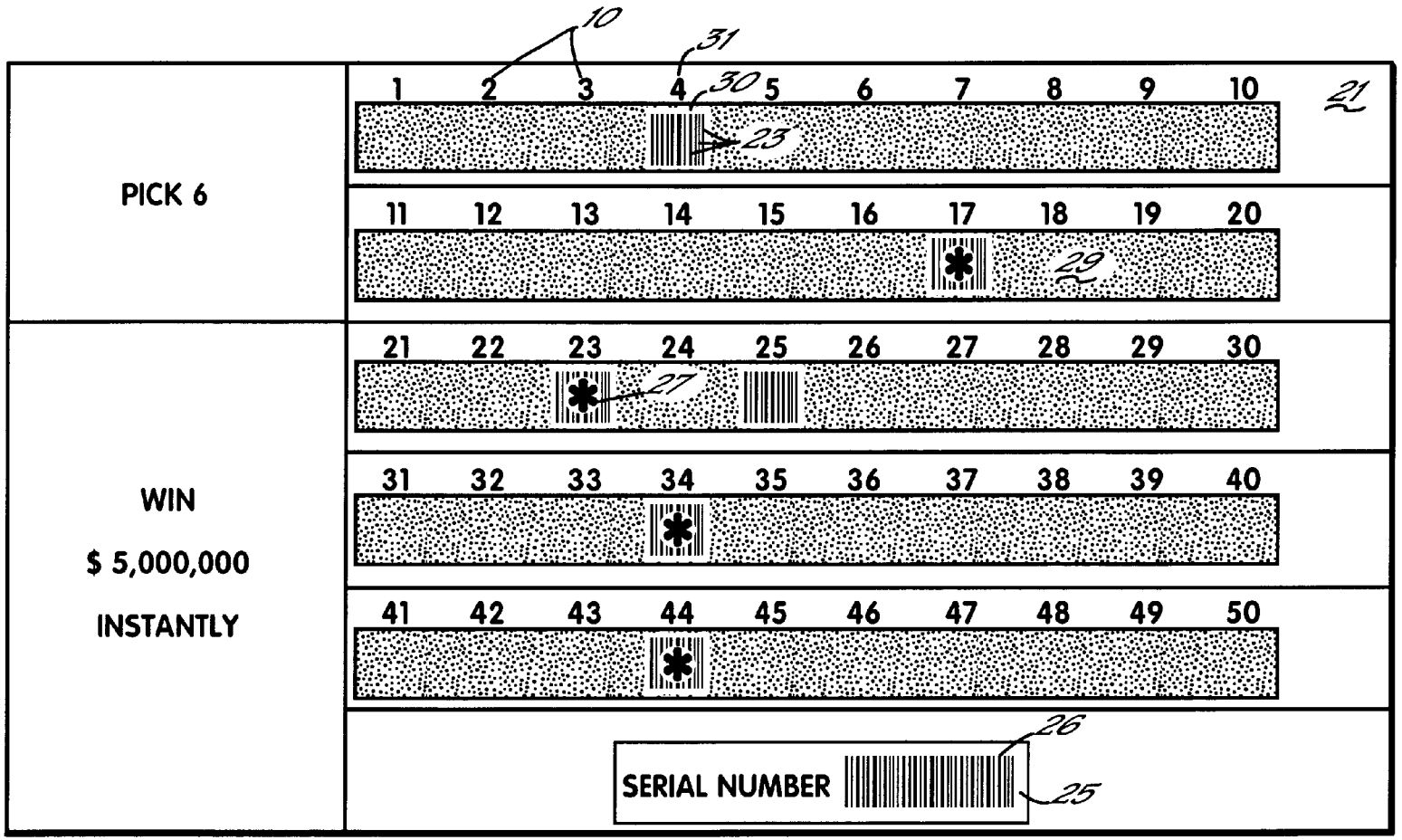
FIG. 7 is a drawing of another embodiment of a ticket in accordance with the present invention.
Figure 8:
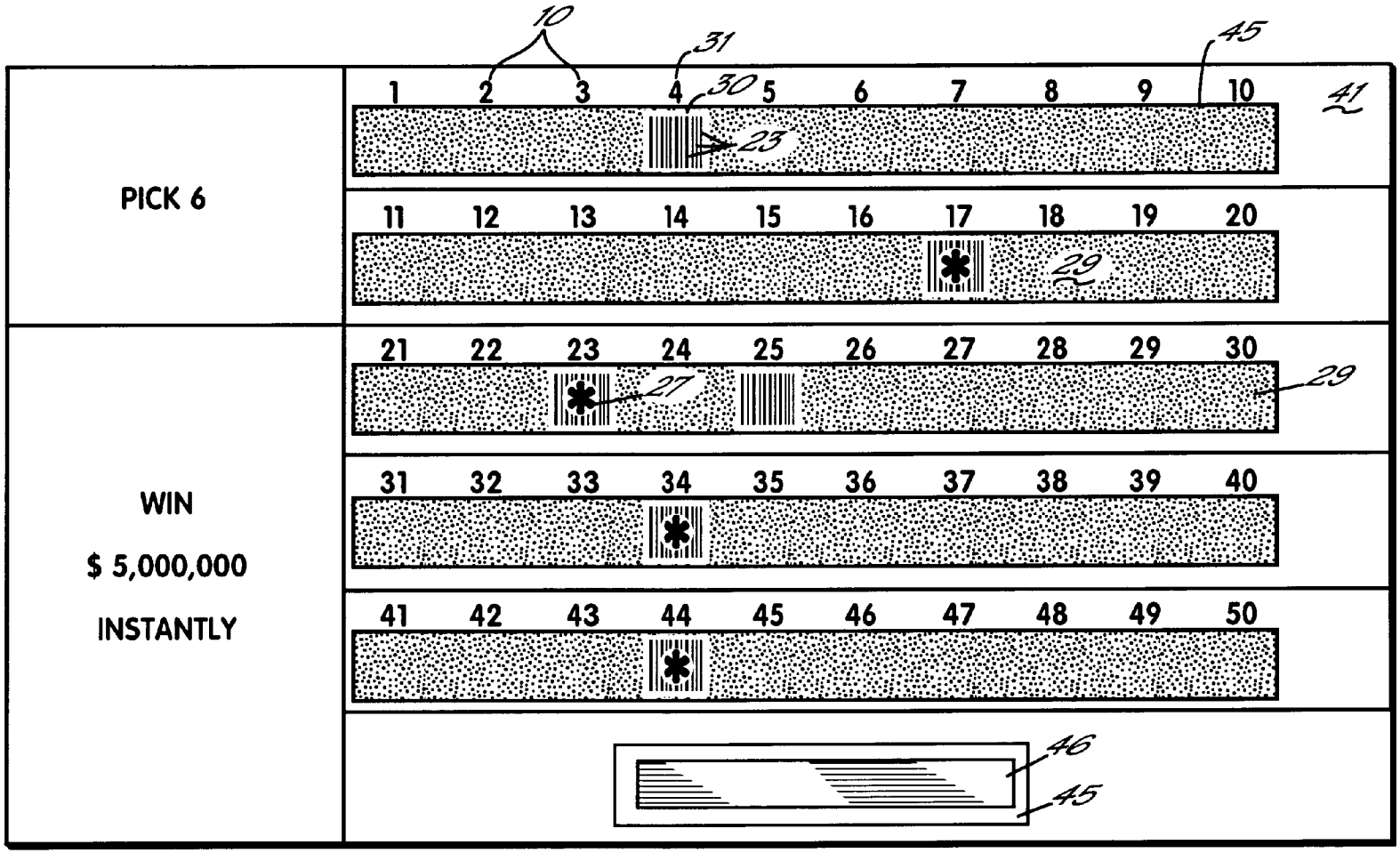
FIG. 8 is a drawing of still another embodiment of a ticket in accordance with the present invention.

FIG. 7 discloses a lottery ticket 21 which has a plurality of game fields 30, which may or may not be associated with one or more numerical or other symbols 31. Lottery card 21 also includes a field 25 for the serial number of the card and the scanner-readable code 26 utilized to interpret the card's authenticity as well as whether the card is a winning card, a losing card, or an invalidated card. The winning game fields 30 are indicated by a hidden symbol 27 within the game field 30. The object of a person playing the game represented by the lottery card 21 is to find each of the winning symbols 27 that are hidden in the game fields 30 by scratch-off material 29. As discussed above, scratch-off material is scraped from a particular game field to reveal whether that game field contains a hidden winning symbol 27 or whether the game field is a losing game field. The number of hidden winning symbols 27 on the card 21 is determined by the type of game associated with the card. For example, four, five or six winning symbols might have to be revealed, although a greater or lesser number might also be utilized for the game of card 21. A person playing the game can only scratch off a designated number of symbols. In FIG. 7, the game is a pick six type of game, and thus, six fields are revealed by scratching off material 29 to reveal the contents of those fields. If the player is chosen correctly and has scratched off the material 29 to reveal six wining symbols 27, then that person is a winner and the card 21 represents a winning card. In FIG. 7, the fields represented by numerals 17, 23, 34, and 44 all show winning symbols 27 therein and, thus, would be considered winning game fields 30. However, the scratched-off fields indicated by numbers 4 and 25 do not contain a winning symbol 27 and, thus, would be considered losing fields. While the ticket 21 would then not be considered a winning ticket for the pick six contest, there may be other levels of contest such as getting four or five fields within the pick six game. That is, as discussed above, related games might also be associated with card 21, and thus, four winning fields with winning symbols 27 could indicate a winning card at a particular level. Usually, the money for matching or uncovering four or five winning fields within a pick six card 21 will be less than the money prize for getting all six of the fields correct.

In accordance with one aspect of the present invention, as discussed above, a card such as card 21 shown in FIG. 7 might be invalidated if scratch -off material 29 from more than six fields 30 is removed. That is, if the scratch -off material from seven, eight, or a greater number of fields is removed, the ticket 21 would be invalid. Of course, a lesser number of fields than six might also be scratched off and not necessarily invalidate the card. For example, if the person is happy with finding four or five of the hidden winning symbols 27, they may not scratch-off a sixth field. It seems unlikely that such a situation would occur, but it is possible.

For the purposes of validating a winning ticket 21 or invalidating the ticket, beneath the scratch-off material for any given game field 30 is a scanner-readable code 23, such as a bar code. The scanner would verify that only six or less bar codes are revealed by the game fields 30 from which the scratch-off material has been removed. To that end, the scanner-readable code is printed within the fields 30. For a winning game field, the scanner-readable code 23 is printed along with a winning symbol 27 as shown in the fields 17, 23, 34 and 44 in the example of FIG. 7. In the embodiment of the invention described hereinabove, the scanner-readable code or bar code was printed on the scratch -off material, and thus, a scanner would detect the absence of greater than six codes to invalidate a ticket or equal to or less than six fields to indicate a valid ticket regardless of whether the ticket is a winning ticket or not. Of course, the maximum number of fields from which the scratch-off material may be removed will depend upon the type of game indicated by the card 21.

To verify a winning ticket, a device such as a computer, would verify that only a certain number of fields have been chosen by checking the number of exposed codes 23. It should be noted that while FIG. 7 shows the winning symbols 27 over the codes 23 for illustration, the codes 23 are still readable. If necessary, the winning symbols 27 may be placed adjacent to the codes so as not to interfere with the reading of the codes.

While this invention has been described as having a preferred design, it is understood that it is capable of further modification, uses and/or adaptations of the invention following in general the principles of the invention and including such departure from the present disclosure as comes within the known or customary practice in the art to which the invention pertains and as may be applied to the central feature hereinbefore set forth, and fall within the scope of the invention and the limits of the appended claims.

An example of this modification is the association of the fields with letters or symbols or even no association with anything, just presenting fields as fields for selection by a player.

What is claimed is:

1. A tamper resistant lottery ticket for preventing payoff of invalid tickets comprising:

a ticket body;

a plurality of game fields which are choosable by a lottery player;

at least one winning symbol for the ticket positioned in a game field;

a scratch-off material covering the game fields to hide contents of the game fields and therefore hide the at least one winning symbol, the scratch-off material removable by a lottery player to reveal the contents of a game field when the game field is chosen;

a readable security code printed in each of the game fields, the security code being covered by scratch-off material with the at least one winning symbol and being revealed when the game field is chosen and the scratch-off material is removed to reveal the contents of the game field;

a readable magnetic strip positioned on the ticket body, the magnetic strip containing information regarding the lottery ticket, which information, when combined with the revealed security codes, may be used to determine the validity of the ticket.

2. The tamper resistant lottery ticket of claim 1 wherein said information comprises a serial number for the ticket associated with the game fields for the ticket.

3. The tamper resistant lottery ticket of claim 2 wherein said serial number is indicative of the number of game fields and their contents which may be revealed for the ticket to be a valid ticket.

4. The tamper resistant lottery ticket of claim 1 further comprising a plurality of winning symbols in the game fields.

5. The tamper resistant lottery ticket of claim 4 wherein said plurality of winning symbols is a predetermined number of winning symbols for fixing the number of game fields which are revealable for a valid ticket.

6. A method for playing a lottery game with tickets and preventing payoff of an invalid lottery ticket comprising:

providing a ticket to a player having a plurality of game fields thereon which are choosable by a lottery player;

providing a scratch-off material on the ticket for covering the game fields to hide contents of the game fields, the scratch-off material being removable by a lottery player to reveal the contents of a game field when the game field is chosen by the player;

providing a readable security code within each game field and beneath the scratch off material of the game field, the security code being revealable when the scratch off material is removed to reveal the chosen game field contents;

providing a readable magnetic strip containing information regarding the lottery ticket;

instructing the lottery player to choose a predetermined number of the game fields and to remove the scratch-off material of the chosen game fields to reveal the contents of the chosen game fields;

reading the security codes of the game fields after the lottery player has chosen to determine the number of game fields having the scratch-off material removed by the player, and reading the magnetic strip to obtain the information regarding the game associated with the lottery ticket;

comparing the number of game fields, with the scratch-off material removed, to the information regarding the lottery ticket to determine if the proper number of game fields were chosen by the player;

determining the validity of the lottery ticket based upon said comparison step.

7. The method of claim 6 further comprising providing serial number information on the magnetic strip on the ticket, the serial number associated with the predetermined number of choosable game fields.

8. A tamper resistant lottery ticket for preventing payoff of invalid tickets comprising:

a ticket body;

a plurality of game fields which are choosable by a lottery player;

at least one winning symbol for the ticket positioned in a game field;

a scratch-off material covering the game fields to hide contents of the game fields and therefore hide the at least one winning symbol, the scratch-off material removable by a lottery player to reveal the contents of a game field when the game field is chosen;

a readable security code printed on the scratch-off material of the game fields, the security code being removable when the scratch-off material is removed;

a readable magnetic strip positioned on the ticket body, the magnetic strip containing information the lottery ticket, which information, when combined with the security code, may be used to determine the validity of the ticket.

9. The tamper resistant lottery ticket of claim 8 wherein said information comprises a serial number for the ticket associated with the game fields for the ticket.

10. The tamper resistant lottery ticket of claim 9 wherein said serial number is indicative of the number of game fields and their contents which may be revealed for the ticket to be a valid ticket.

11. The tamper resistant lottery ticket of claim 8 further comprising a plurality of winning symbols in the game fields.

12. The tamper resistant lottery ticket of claim 11 wherein said plurality of winning symbols is a predetermined number of winning symbols for fixing the number of game fields which are revealable for a valid ticket.

13. The tamper resistant lottery ticket of claim 9 wherein said serial number is also associated with the number of game field contents which may be revealed for the ticket to be a valid ticket.

* * * * *

UNITED STATES PATENT AND TRADEMARK OFFICE

CERTIFICATE OF CORRECTION

PATENT NO. : 6,270,406 B1
DATED : March 26, 2002
INVENTOR(S) : Hashem Sultan

It is certified that error appears in the above-identified patent and that said Letters Patent is hereby corrected as shown below:

Column 3,
Line 30, delete ";" and insert -- , --.

Column 5,
Lines 14-15, delete "the contents of the game fields and"

Column 6,
Lines 23-24, delete "1/10,373,573" and insert -- 1/10,737,573 --.

Column 7,
Line 6, delete "is chosen" and insert -- has chosen --.
Line 7, delete "wining" and insert -- winning --.

Column 10,
Line 5, after "strip containing information" insert -- regarding --.

Signed and Sealed this

Fourth Day of June, 2002

*Attest:*

*Attesting Officer*

JAMES E. ROGAN
*Director of the United States Patent and Trademark Office*